United States Patent [19]

Deal

[11] 4,246,862

[45] Jan. 27, 1981

[54] SELF-CLEANING WEEDLESS PROPELLER

[76] Inventor: Troy M. Deal, 277 Trismen Ter., Winter Park, Fla. 32789

[21] Appl. No.: 18,134

[22] Filed: Mar. 7, 1979

[51] Int. Cl.[3] ..... B63H 1/14

[52] U.S. Cl. ..... 440/73; 416/122; 416/176

[58] Field of Search ..... 115/40, 42, 20, 37; 415/72, 121 B; 416/122, 146 R, 176, 177

[56] References Cited

U.S. PATENT DOCUMENTS

| | | | |
|---|---|---|---|
| 756,031 | 3/1904 | Lee | 115/40 |
| 938,911 | 11/1909 | Taylor | 115/40 |
| 1,110,497 | 9/1914 | Konitzko | 416/122 |
| 1,713,448 | 5/1929 | Roe | 416/122 |
| 2,295,633 | 9/1942 | Chase | 415/121 B |
| 2,470,874 | 4/1949 | Sidney | 115/40 |
| 2,501,617 | 3/1950 | Roesch | 115/37 |
| 3,283,829 | 11/1966 | Aumarechal | 416/146 |
| 3,695,173 | 10/1972 | Cox | 415/72 |
| 3,971,148 | 7/1976 | Deal | 198/497 |

FOREIGN PATENT DOCUMENTS

| | | | |
|---|---|---|---|
| 256544 | 4/1970 | U.S.S.R. | 115/40 |

*Primary Examiner*—Edward R. Kazenske
*Attorney, Agent, or Firm*—Beaman & Beaman

[57] ABSTRACT

A self cleaning attachment for a propeller shaft having a gear box mounting parallel stub shafts driven in the same direction by a common gear, screw propeller surfaces on the shafts with teeth on the outer edge of each propeller surface and having weed shearing clearance with the shaft of the other surface, and stub shear bars supported in fixed relation to the box and disposed radially outward and parallel to the shafts with which the teeth also have weed shear clearance with the bars.

1 Claim, 4 Drawing Figures

SELF-CLEANING WEEDLESS PROPELLER

BACKGROUND OF THE INVENTION

The aquatic growths of lakes, rivers, canals and other waterways present a problem to the operation of the propellers of both outboard and inboard motors of watercraft. Weeds wrap around the propeller shaft and prevent efficient operation.

In the case of an outboard motor, the motor may be tilted out of the water and the weeds manually removed. Inboard motors present more of a problem and require manually removing the weeds from the propeller shaft under water unless the accumulation may be removed by reversing the direction of rotation of the shaft.

Numerous proposals have been made to protect the propeller shaft from aquatic growths. Reference may be made to U.S. Pat. Nos. 2,355,842; 2,470,874; and 2,690,728.

SUMMARY OF THE INVENTION

In the preferred illustrated form of the invention, the usual propeller shaft driven by the engine, in lieu of being directly connected to the conventional propeller used on watercraft, terminates in a gear box. The gear box supports and drives a pair of parallel shafts equipped with propellers. Similar gears in the gear box drive the shafts in timed relation through a common gear on the input shaft to the gear box.

Embracing the parallel shafts and supported in fixed relation to the gear box is a propeller cleaning bar having teeth. Teeth are also provided on the propellers to be rotated in shear relation with weeds that might accumulate upon either the teeth of the cleaning bars or on the parallel shafts of the propellers. Reference should be made to my U.S. Pat. No. 3,971,148.

DESCRIPTION OF THE PREFERRED EMBODIMENT

Figure 2:
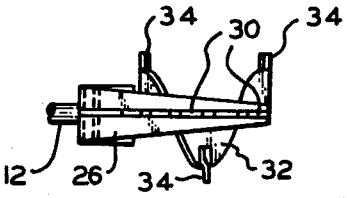
FIG. 2 is a top view of FIG. 1.
Figure 1:
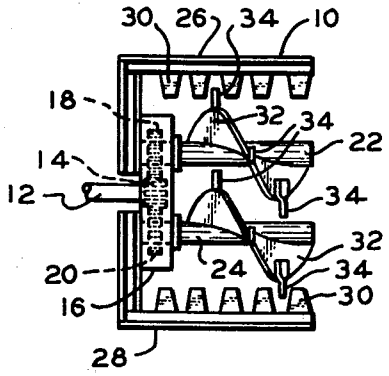
FIG. 1 is a side elevational view of an attachment for a propeller shaft.
Figure 4:
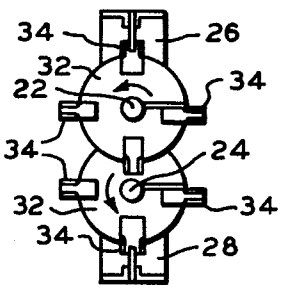
FIG. 4 is an end view of FIG. 1 taken from the left.
Figure 3:
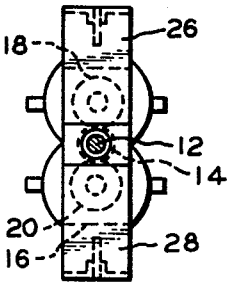
FIG. 3 is an end view of FIG. 1 taken from the right.

The invention has been illustrated as an attachment to the conventional propeller shaft of an outboard motor. As shown, the attachment 10 is mounted on the usual propeller shaft 12. A suitable bracket (not shown) supports the attachment against movement relative to the usual outboard motor housing.

The shaft 12 is suitably keyed to a drive gear 14 located in the gear box 16. Similar driven gears 18 and 20 mesh with the drive gear 14. Parallel shafts 22 and 24 are supported in the gear box 16 and support the gears 18 and 20 in suitable drive key relation.

Attached to the gear box 16 are rigid L-members constituting cleaning bars 26 and 28 carrying cleaning teeth 30. Rigid with the shafts 20 and 24 are helical segments defining screw propellers 32 each provided with four propeller teeth 34 disposed at 90° to each other along the helical segments and rotated with the segments.

The angular relationship of the propellers 32 to each other and the timing of the shafts 22 and 24 through the gears 18 and 20 is such that the teeth 34 in same plane normal to the axis of rotation of the shafts 22 and 24 are always in the same angular relationship. It will also be noted that the teeth 34 rotate in weed shearing relation with the teeth 30 as well as with the shafts 22 and 24 keeping the shafts 22 and 24 relatively free from weeds. It is anticipated that the members 26 and 28, along with their teeth 30, may be omitted and the weed shearing clearance between the teeth 34 and shafts 22 and 24 be solely relied upon to clear the propeller means of weeds. The weed shearing clearance between the teeth 30 and 34 and the teeth 34 and the shafts 22 and 24 are described in detail in my aforesaid U.S. Pat. No. 3,971,148.

I claim:

1. A self cleaning attachment for the propeller shaft of water craft used in waterways infested with weeds comprising a gear box adapted to be mounted on a propeller shaft and held against rotation, a pair of parallel stub shafts mounted in said box and driven in the same direction in timed relation by a common gear on said propeller shaft, helical screw propeller surfaces carried on said stub shafts and each of said propeller surfaces having radially extending teeth on the outer edge thereof, the teeth on one of said propeller surfaces having weed shearing clearance with the stub shaft of the other of said propeller surfaces respectively, and stub shear bars supported in fixed relation to said box and disposed radially outward and parallel to said stub shafts, said shear bars having cleaning teeth thereon which have weed shearing clearance with the teeth on said propeller surfaces.

* * * * *